US005314234A

United States Patent [19]

England

[11] Patent Number: 5,314,234

[45] Date of Patent: May 24, 1994

[54] SECTIONAL SOFA ASSEMBLY WITH DUAL RECLINING SEATS

[75] Inventor: Michael E. England, Tazewell, Tenn.

[73] Assignee: England Corsair Upholstery Mfg. Co., Inc., New Tazewell, Tenn.

[21] Appl. No.: 959,383

[22] Filed: Oct. 13, 1992

[51] Int. Cl.[5] ..... A47C 17/02

[52] U.S. Cl. ..... 297/248; 297/411.27; 297/194; 5/12.2; 5/52

[58] Field of Search ..... 297/248, 416, 192, 194, 297/232, 411.26, 411.27; 5/12.2, 52

[56] References Cited

U.S. PATENT DOCUMENTS

| | | | |
|---|---|---|---|
| 2,087,574 | 7/1937 | Kanfer | 297/248 X |
| 2,793,685 | 5/1957 | Spitz | 297/416 |
| 3,614,157 | 10/1971 | Hendrickson et al. | 297/248 |
| 3,704,911 | 12/1972 | Milakovich | 297/416 X |
| 3,973,800 | 8/1976 | Kogan | 297/248 X |
| 4,651,363 | 3/1987 | Mizelle | 5/12.2 X |
| 4,668,011 | 5/1987 | Fister, Jr. | 297/218 |
| 4,740,031 | 4/1988 | Rogers Jr. | 297/85 |
| 4,989,914 | 2/1991 | Pine | 297/85 |
| 5,064,244 | 11/1991 | Sproule | 297/68 |
| 5,106,153 | 4/1992 | Durling | 297/194 X |

FOREIGN PATENT DOCUMENTS 2003910 1/1970 Fed. Rep. of Germany .

*Primary Examiner*—Michael F. Trettel

*Attorney, Agent, or Firm*—Rhodes, Coats and Bennett

[57] ABSTRACT

A sectional sofa assembly including a dual seat reclining section attached to a sofa. The dual reclining section includes a pair of reclining seats that are positionable between an adjacent position where the reclining seats are positioned adjacent to one another and a separated position where an armrest module is connectable between the reclining seats. The modules of the sectional sofa assembly are detachably connected together in selected positions by male and female connector portions. The armrest module includes an armrest surface that forms a top-opening lid to a compartment. The armrest module further includes a tabletop and a bottom drawer.

15 Claims, 4 Drawing Sheets

SECTIONAL SOFA ASSEMBLY WITH DUAL RECLINING SEATS

FIELD OF THE INVENTION

The present invention relates generally to furniture assemblies, and more particularly, to sectional sofa assemblies.

BACKGROUND OF THE INVENTION

Sectional sofa assemblies having dual reclining seats are known in the prior art. Conventionally, dual reclining seats of sectional sofa assemblies have been positioned at the opposite ends of the sofa assembly as shown in U.S. Pat. No. 4,740,031 to Rogers, Jr., issued Apr. 26, 1988. The prior art has also provided a sofa section with a pair of reclining seats integrally connected by an armrest module, as shown in U.S. Pat. No. 5,064,244 to Sproule, issued Nov. 12, 1991. However, some users would prefer that the reclining seats be positioned in an adjacent position without a separating armrest module. The prior art, however, does not provide a sectional sofa assembly that has reclining seats that are selectively adjustable between an adjacent position and a separated position where the armrest module is connected between the reclining seats.

Prior art sectional sofa assemblies also do not disclose an armrest module providing conveniently positioned compartments and table tops located on the armrest module. For example, U.S. Pat. No. 5,064,244 discloses an armrest module with compartments, but does not disclose a compartment positioned for convenient user access. Accordingly, there remains a need in the art for a sectional sofa assembly providing user-selectable flexibility in module arrangement.

SUMMARY OF THE INVENTION

The present invention fulfills this need by providing an improved sectional furniture assembly having reclining sections detachably connectable to a sofa section. The reclining sections may include a pair of reclining seats that are detachably positionable in a plurality of selected positions. The reclining sections are positionable between an adjacent position where the reclining seats are adjacently connected to one another and a separated position where an armrest module is connected between the pair of reclining seats.

A plurality of connector portions allow a user to easily position and secure the sectional furniture modules in a variety of selected positions. Male ones of the connector portions extend between adjoining modules or sections to connect the furniture assembly together. In particular, the connector portions allow the reclining sections to be positioned in either the adjacent position or the separated position.

The connector means may include male and female connector portions mounted on opposite sides of at least the armrest module. The furniture assembly may include end modules and, male connector portions are located on the same side of each module except for the end sides of end modules, and female connector portions are located on the opposite side of each module from the male connector portions except for the end sides of end modules.

In a preferred embodiment he female connector portion includes a plate secured to the module and has a vertically-extending, open-topped slot. The male connector portion includes a shank protruding from the side of the module and terminating in a knob.

A further aspect of the invention provides an armrest module. The module includes a cushioned armrest, a compartment positioned underneath the cushioned armrest so that the cushioned armrest forms an openable top lid for the compartment, a table positioned adjacent the compartment, wherein the table provides a generally horizontal surface on which objects may be placed, and a pull-open drawer positioned below the table.

Yet another aspect of the invention provides a method of assembling a furniture assembly having a plurality of seat modules. The method includes placing an end module having a female connector portion on its side at a desired placement, locating a module adjacent the end module by lowering the module with a knob of a male connector portion into the female connector portion of the end module, and continuing to locate additional modules adjacent the just-positioned module by lowering the additional module with a knob of a male connector portion into the female connector portion of the just-positioned module until a desired furniture assembly is completed.

BRIEF DESCRIPTION OF THE DRAWINGS

The invention will be better understood from a study of the following description and the accompanying drawings which are merely illustrative of such invention.

DETAILED DESCRIPTION OF THE INVENTION

Figure 1:
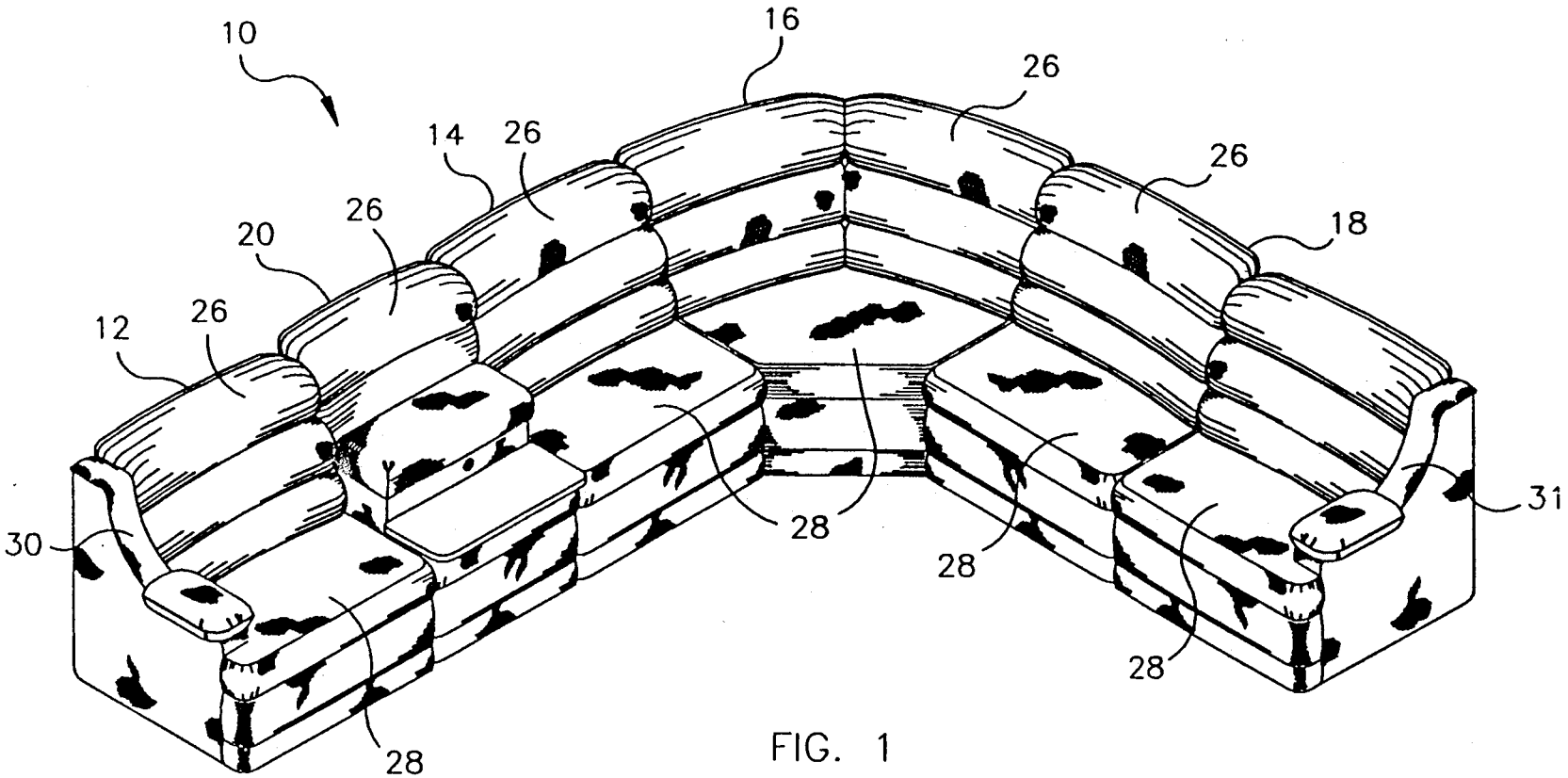
FIG. 1 is a perspective view of one embodiment the sectional sofa assembly of the present invention showing the reclining seats in a separated position with the armrest module connected therebetween.

Referring to the drawings, the sectional sofa assembly of the present invention is indicated generally by the numeral 10. Sectional sofa assembly 10 may be arranged in a plurality of selected combinations or permutations and includes reclining seats 12 and 14, a wedge-shaped module 16, a sofa 18, and an armrest module 20.

Reclining seats 12 and 14 together form a dual reclining section of sofa assembly 10. Each reclining seat 12 and 14 includes a frame having a plurality of legs attached to a leg rail (not shown). Attached to the frame of reclining seats 12 and 14 is a conventional back rest cushion 26 and a seat cushion 28. Reclining seat 12 includes a single armrest 30 located on one side of recliner 12, whereas reclining seat 14 has no armrests and is open on both sides. Reclining seat 14 can also be configured to have a left-hand armrest instead of the right-hand armrest 30 shown in FIG. 1.

Wedge-shaped module 16 and sofa 18 also each include a frame having a plurality of legs attached to leg rails. Wedge 16 and sofa 18 each include conventional back rest cushions 26 and seat cushions 28, and an armrest 31 on one end of sofa 18. As with reclining seats 12 and 14, the armrest 31 of the sofa 18 can be located on its other end. The alternate armrest placement permits different sectional assembly configurations.

Figures 2, 2A:
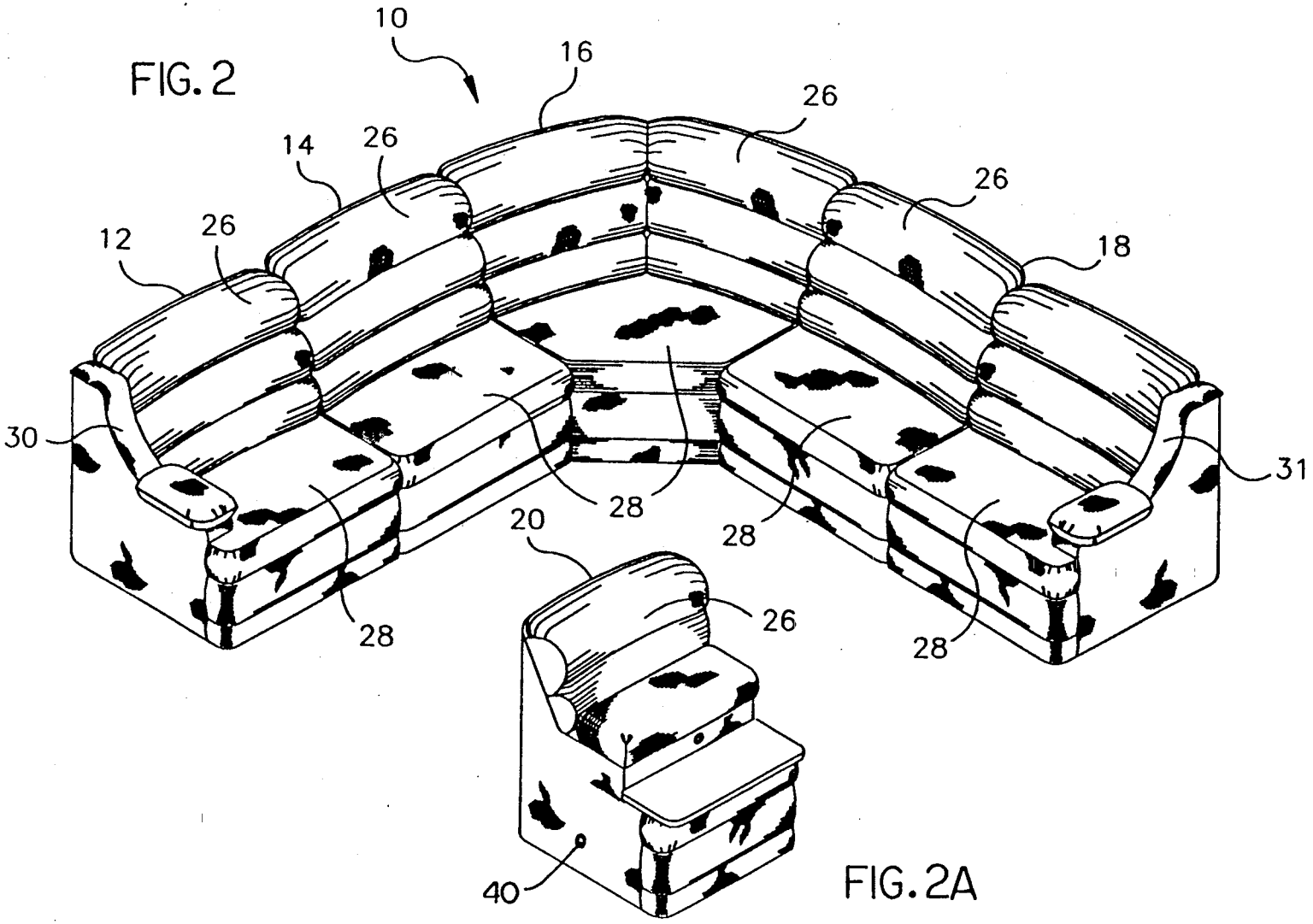
FIG. 2 is a perspective view of the sectional sofa assembly showing the reclining seats in an abutted or adjacent position, with the armrest module shown separated.
FIG. 2*a* is a perspective view of the armrest module separated from the sectional sofa assembly.

The armrest module 20 (as well as the other modules) may be removed from the assemblage. Armrest module 20 is shown so separated in FIG. 2, thereby exposing a male connector portion 40 on its left side, as the module is faced from the front. Armrest module 20 has a female connector portion on its right side, like the female connector portion 32 shown in FIG. 4A. Similarly, all of the modules have male connectors on the their left sides and female connectors on their right sides, except sides that are to be end units, such as arms 30 and 31.

Figure 4A:
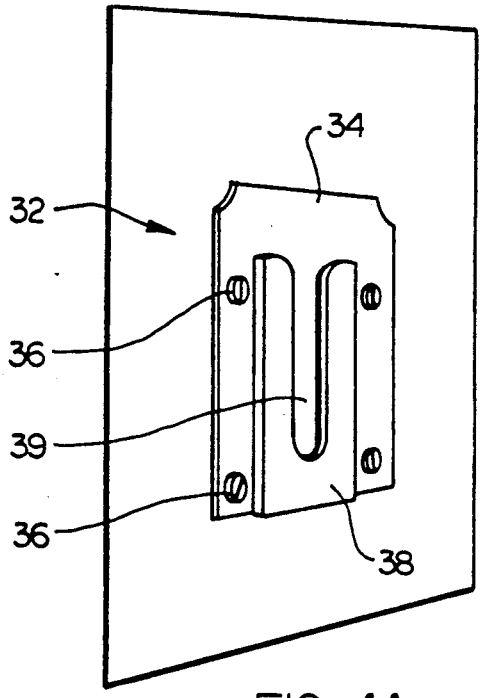
FIG. 4A is an enlarged, perspective view showing a female portion of a connector affixed to one module.

As seen in FIG. 4A the female connector portion 32 includes a flat plate 34 secured to the rail of the module by screws 36. A raised surface 38 extends from the plate 34 and has a vertically-extending, open-topped slot 39.

Figure 4B:
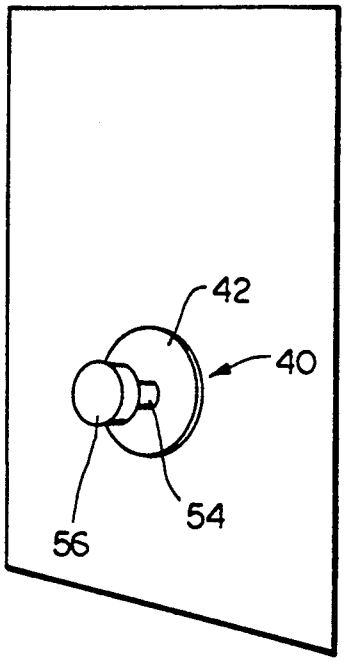
FIG. 4B is an enlarged, perspective view showing a male portion of a connector affixed to one module.

As seen in FIG. 4B the male connector portion 40 includes a flange 42 secured to the rail of the module by, for example a screw (not shown). Shank 54 protrudes from the flange 42 and terminates in a knob 56. Shank 54 is preferably quite short, since its length need only span a short distance to reach slot 39, when the modules are side by side. The knob 56 is made with a diameter greater than the width of the slot 39, and shank 54 has a diameter less than the width of the slot 39.

Figure 3:
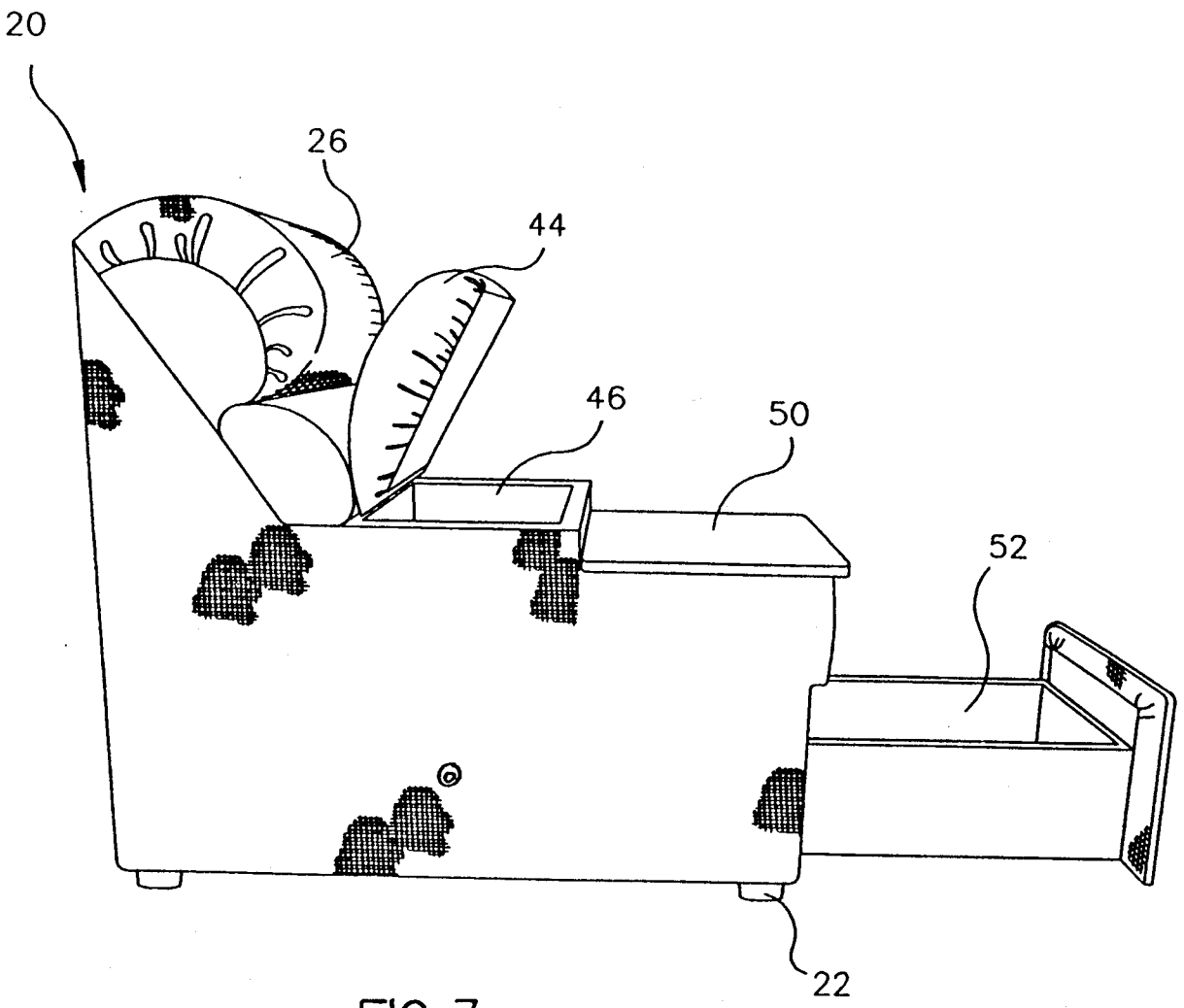
FIG. 3 is a perspective view of the armrest module.

Referring to FIG. 3, armrest module 20 includes an armrest surface 44 that is cushioned. Armrest surface 44 also serves as a lid to a compartment 46. A table top 50 is positioned adjacent to armrest surface 44 and acts as a convenient surface to place drinks and other articles. Positioned below tabletop 50 is a bottom drawer 52.

In operation, a user can easily position sectional sofa assembly 10 in a variety of selected configurations. The connector portions shown in FIGS. **4*a* and 4*b*, allow a user to connect any two of the furniture modules together, to selectively connect furniture assembly 10 in a variety of positions. The collection of modules is assembled by starting with a desired placement of a left-most unit. Then the module to be located to its right is positioned by lowering the knob of its male connector 40 into the female connector portion 32** of the pre-positioned module. The process continues to the right until the right-most module is located. Of course, the right- and left-hand positions of the male and female connector portions could be reversed, in which case the assembly process would proceed from right to left.

If desired, the assembled modules may be rearranged by simply lifting the right-most unit to separate it from its neighbor, and proceeding to the left in similar fashion. The modules are them reassembled as desired.

Armrest module 20 provides a user with a convenient armrest when it is positioned between the reclining seats 12 and 14. Armrest surface 44 of armrest module 20 also acts as a top lid of compartment 46. In addition, drink glasses may be conveniently laid on table top 50 and other items may be stored in bottom drawer 52.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A furniture assembly comprising:

(a) a first reclining seat module having a frame member and being without an armrest on at least one side;

(b) a second reclining seat module having a frame member and being without an armrest on at least one side;

(c) an armrest module including a frame member and an armrest surface; and (d) connector means for detachably connecting the first and second reclining seat modules between an adjacent position where the sides of the first and second reclining seat modules without the armrests are adjacently positioned and a separated position where the armrest module is detachably connected between the first and second reclining seat modules.

2. The furniture assembly of claim 1 wherein the connector means includes male and female connector portions mounted on opposite sides of at least the armrest module.

3. The furniture assembly of claim 2 further comprising end modules having end sides and wherein male connector portions are located on the same side of each module except for the end sides of end modules, and female connector portions are located on the opposite side of each module from the male connector portions except for the end sides of end modules.

4. The furniture assembly of claim 2 wherein the female connector portion includes a plate secured to the module and having a vertically-extending, open-topped slot.

5. The furniture assembly of claim 2 wherein the male connector portion includes a shank protruding from the side of the module and terminating in a knob.

6. The furniture assembly of claim 2 wherein the female connector portion includes a plate secured to the module and having a vertically-extending, open-topped slot and the male connector portion includes a shank protruding from the side of the module and terminating in a knob.

7. The furniture assembly of claim 1 wherein the arm rest module includes a compartment in the frame member and the cushioned-arm rest is raisably secured above said compartment to form a top-opening lid to the compartment in the arm rest module.

8. The furniture assembly of claim 7 wherein the armrest module further includes a drawer.

9. The furniture assembly of claim 1 wherein the armrest module includes a table top.

10. A furniture assembly comprising:

(a) an armrest module having a frame, the frame of the armrest module including a plurality of legs attached to a leg rail;

(b) first and second reclining seat modules, each seat reclining module including a frame having a plurality of legs attached to a leg rail;

(c) a sofa module including a frame having a plurality of legs attached to a leg rail;

(d) connector portions located on the sides of each of the modules except any of the modules serving as end units, the connector portions including a female connector portion having a vertically-extending, open-topped slot and a male connector portion including a shank protruding from the side of the module and terminating in a knob; and (e) wherein modules are detachably connectable to adjacent modules by having a shank of a male connector positioned in the slot of the female connector of a neighboring module to prevent the modules from being pulled apart.

11. The furniture assembly of claim 10 wherein the arm rest module includes a compartment in the frame member and the cushioned arm rest is raisably secured above said compartment to form a top-opening lid to the compartment in the arm rest module.

12. The furniture assembly of claim 11 wherein the armrest module includes a table top.

13. The furniture assembly of claim 12 wherein the armrest module further includes a drawer.

14. A furniture assembly comprising:

(a) a armrest module having a frame member;

(b) a female connector portion located on one side of said armrest module including a plate secured to the module and having a vertically-extending, open-topped slot; and (c) a male connector portion including a shank protruding from the opposite side of the module and terminating in a knob.

15. An arm rest module comprising:

(a) a cushioned arm rest;

(b) a compartment positioned beneath the cushioned arm rest and having the cushioned arm rest raisably secured thereto, so that the cushioned arm rest forms an openable top lid for the compartment;

(c) a table positioned adjacent the compartment, wherein the table provides a generally horizontal surface on which objects may be placed; and (d) a pull-open drawer positioned below the table.

* * * * *